US007686572B2

(12) United States Patent
Wahl et al.

(10) Patent No.: US 7,686,572 B2
(45) Date of Patent: Mar. 30, 2010

(54) PUMP COMPRISING AN AXIAL BALANCING SYSTEM

(75) Inventors: Fabien Wahl, Saint Marcel (FR); Francois Danguy, Tourny (FR); Stephane Laffite, Vernon (FR); Philippe Bourdin, Saint Marcel (FR)

(73) Assignee: SNECMA, Paris (FR)

( * ) Notice: Subject to any disclaimer, the term of this patent is extended or adjusted under 35 U.S.C. 154(b) by 577 days.

(21) Appl. No.: 11/580,159

(22) Filed: Oct. 13, 2006

(65) Prior Publication Data

US 2008/0080965 A1 Apr. 3, 2008

(30) Foreign Application Priority Data

Sep. 28, 2006 (FR) ..... 06 53984

(51) Int. Cl.
*F04D 29/041* (2006.01)
*F04D 29/042* (2006.01)

(52) U.S. Cl. ..... 415/26; 415/48; 415/104; 415/106; 415/107; 415/173.5

(58) Field of Classification Search ..... 415/104, 415/106, 107, 14, 26, 48–50, 172.1, 173.5, 415/174.5; 417/365
See application file for complete search history.

(56) References Cited

U.S. PATENT DOCUMENTS

| | | | | |
|---|---|---|---|---|
| 1,986,706 | A * | 1/1935 | Beyer | 415/173.5 |
| 3,664,758 | A * | 5/1972 | Sato | 415/104 |
| 3,828,610 | A * | 8/1974 | Swearingen | 415/104 |
| 3,874,812 | A * | 4/1975 | Hanagarth | 415/106 |

FOREIGN PATENT DOCUMENTS

| | | | | |
|---|---|---|---|---|
| EP | 0 688 955 | A1 | 12/1995 | |
| FR | 2 057 476 | | 5/1971 | |
| FR | 2 101 348 | | 3/1972 | |
| FR | 2 775 321 | | 8/1999 | |
| JP | 58-155296 | A * | 9/1983 | 415/106 |
| JP | 58-192994 | A * | 11/1983 | 415/106 |
| SU | 1581864 | A1 * | 7/1990 | 415/106 |

* cited by examiner

*Primary Examiner*—Christopher Verdier
(74) *Attorney, Agent, or Firm*—Oblon, Spivak, McClelland, Maier & Neustadt, L.L.P.

(57) ABSTRACT

A pump for the drawing-in of a fluid, including at least one centrifugal wheel having a fluid inlet edge and a fluid outlet edge, the pump further including an axial balancing system with a high-pressure flow space defined between the housing and an upstream face of the centrifugal wheel. The axial balancing system further includes a device for substantially increasing the hydrostatic pressure of the fluid circulating in the high-pressure flow space during operation of the pump.

10 Claims, 1 Drawing Sheet

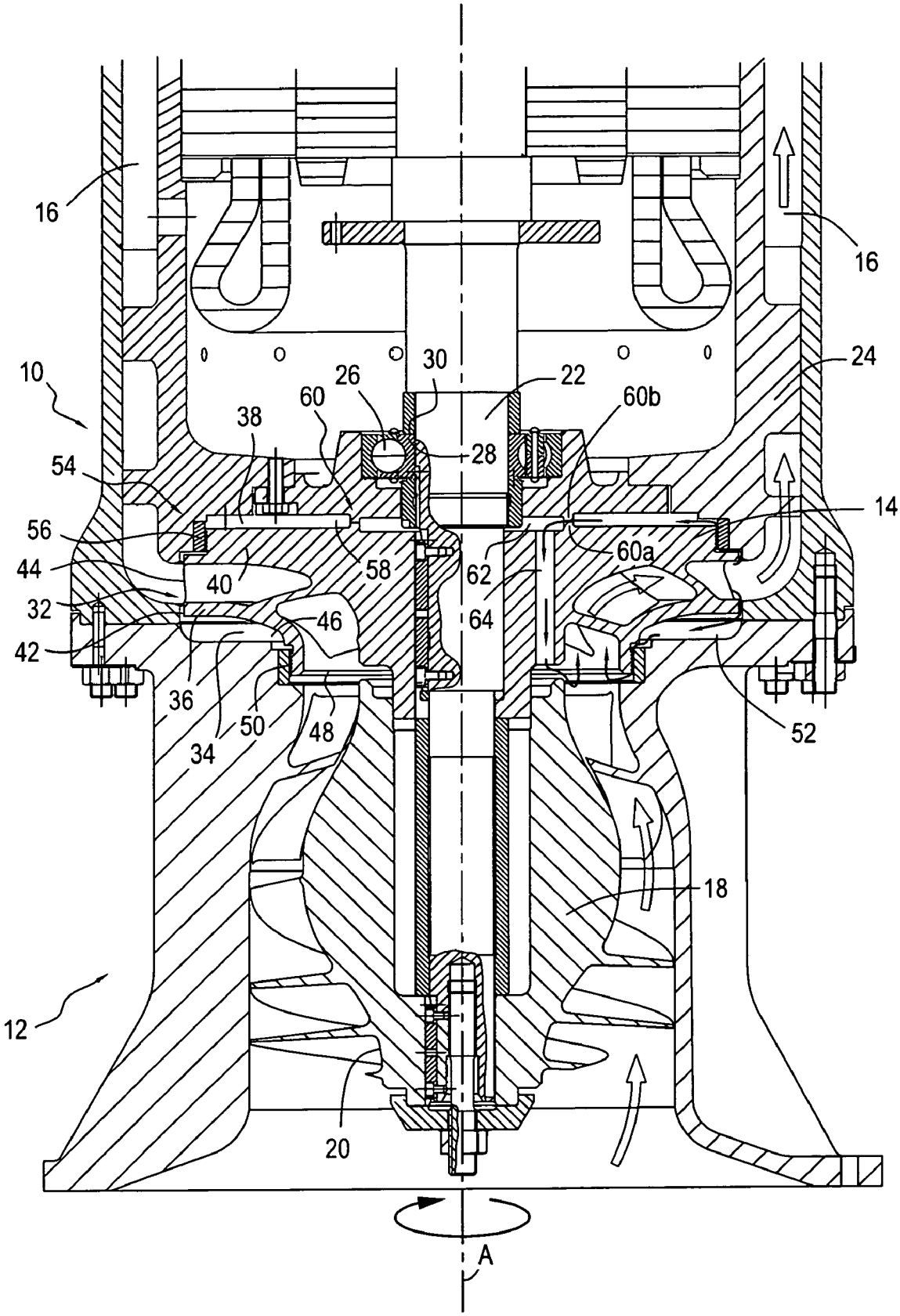
16
16
10
24
30
22
26
60
60b
38
28
54
14
56
60a
44
58
62
40
32
46
64
42
36
50
48
52
34
18
12
20
A

PUMP COMPRISING AN AXIAL BALANCING SYSTEM

The present invention relates to the field of pumps such as, for example, pumps intended to draw in liquefied gas.

A pump of this type is generally intended to be arranged vertically, i.e. so that its axis of rotation extends generally vertically, in such a way that the "bottom" and the "top" of the pump can be defined with reference to a vertical axis of this type.

The terms "axial", "radial" and "tangential" are also defined with reference to the axis of rotation of the pump.

Owing to the substantial mass of specific rotational elements of this pump, in particular the rotating shaft fixed to the rotor of the pump motor, it will be appreciated that there is a considerable gravitational force which tends to displace these elements toward the bottom of the pump.

In addition, the counter-reaction to the pumping generates a tensile force which pulls downward the rotating shaft of the pump and the elements fixed thereto.

This additional force combines with the gravitational force in such a way that the rotating shaft is subjected to considerable stresses directed axially toward the bottom of the pump.

As a result, the bearings provided for guiding the rotating shaft in rotation relative to the housing of the pump experience considerable axial strain owing to these stresses, and this is detrimental to their service life.

In order to overcome this drawback, pumps of this type generally comprise an axial balancing system allowing all or some of these stresses to be compensated.

The present invention relates, more specifically, to a pump for the drawing-in of a fluid, comprising at least one centrifugal wheel having a fluid inlet edge and a fluid outlet edge, the centrifugal wheel being driven in rotation by a shaft mounted so as to be able to rotate relative to a housing of the pump, the pump further comprising an axial balancing system comprising a high-pressure flow space defined between the housing and an upstream face of the centrifugal wheel, a low-pressure flow space defined between the housing and a downstream face of the centrifugal wheel, the high-pressure flow space comprising an inlet arranged in proximity to the outlet edge of the centrifugal wheel and an outlet arranged in proximity to the inlet edge of the centrifugal wheel, said outlet of the high-pressure flow space being equipped with first flow restriction means, the low-pressure flow space comprising an inlet arranged in proximity to the outlet edge of the centrifugal wheel, said inlet being equipped with second flow restriction means, the low-pressure flow space further comprising an outlet having an annular passage forming an axially variable flow restriction and opening radially onto an annular discharge space defined around said shaft radially internally relative to the annular passage, the annular space communicating with a region in which the pressure is lower than that in the low-pressure flow space.

A pump of this type comprising an axial balancing system is already known, in particular from document EP 0 688 955.

In a known manner, the fluid is drawn in via a suction stage then guided toward the inlet edge of the centrifugal wheel, said wheel comprising a conduit having an axially extending inlet and a radially extending outlet in such a way that the fluid experiences centrifugal acceleration before being guided by an annular backstreaming conduit toward the downstream portion of the pump.

Preferably but not necessarily, the flow of fluid into the high and low-pressure flow spaces is centripetal.

The operating principle of the axial balancing system is conventionally as follows: a portion of the fluid issuing from the centrifugal wheel, rather than heading toward the backstreaming conduit, surges between the centrifugal wheel and the housing of the pump, basically owing to the lack of tightness between these two elements.

A first fluid fraction thus flows into the high-pressure flow space, whereas a second fluid fraction flows into the low-pressure flow space.

As the outlet of the high-pressure flow space is, unlike the inlet, restricted by the first flow restriction means, it will be appreciated that the hydrostatic pressure of the first fluid fraction increases as it passes into the high-pressure flow space.

Alternatively, as the inlet of the low-pressure flow space is restricted by the second flow restriction means, it will be appreciated that the hydrostatic pressure of the second fluid fraction decreases as it passes into the low-pressure flow space.

In this case, it will be appreciated that the pressure in the high-pressure flow space is greater than the pressure in the low-pressure flow space in such a way that the centrifugal wheel is subjected to an axial take-up force directed toward the downstream portion of the pump, thus counteracting the above-mentioned axial stresses directed toward the upstream portion of the pump.

It will therefore be appreciated that this axial take-up force allows the bearing or bearings to be relieved.

It will also be appreciated that the intensity of the take-up force is limited by the extent of the surface areas upstream and downstream of the centrifugal wheel, since the force is proportional to the surface area on which the pressure acts.

An object of the present invention is to provide a pump having an improved axial balancing system capable of generating a greater axial take-up force.

The invention achieves its object by the fact that the axial balancing system further comprises means for substantially increasing the hydrostatic pressure of the fluid circulating in the high-pressure flow space during operation of the pump.

It is known that a fluid has an overall pressure equal to the sum of its dynamic pressure and its hydrostatic pressure.

If the hydrostatic pressure of the fluid circulating in the high-pressure flow space is increased, it will be appreciated that the pressure differential between the high-pressure flow space and the low-pressure flow space also increases, as a result of which the axial take-up force is greater than in known pumps.

For a centrifugal wheel of the same size, it is therefore possible to obtain a greater take-up force than in the axial balancing systems already known, thus allowing, for example, operation over a broader flow rate and pressure range.

In other words, the present invention therefore advantageously allows the take-up force to be increased without increasing the diameter of the centrifugal wheel and therefore without increasing the diameter of the pump.

Advantageously, the means for substantially increasing the hydrostatic pressure of the fluid are capable of reducing the tangential component of the fluid circulating in the high-pressure flow space.

Preferably, said means for substantially increasing the hydrostatic pressure of the fluid comprise at least one vane formed on the housing, said vane extending radially and in a centripetal direction from the inlet of the high-pressure flow space. The reason for this is as follows:

This vane obstructs the tangential circulation of the first fluid fraction.

The tangential component of the speed of the first fluid fraction is therefore substantially zero owing to the presence of the vane.

In other words, in the high-pressure flow space, the circulation of the first fluid fraction is basically radial.

Furthermore, the overall speed of the fluid is equal to the square root of the sum of the squares of the radial, tangential and axial components of the fluid speed.

Now, in the present case, the axial component of the speed of the first fluid fraction is substantially zero and, for the reasons mentioned hereinbefore, the tangential component of the speed of the first fluid fraction is also substantially zero.

In the high-pressure flow space, the overall speed of the first fluid fraction is therefore advantageously lower if a vane is provided than if there is no vane.

Moreover, the dynamic pressure of a fluid is proportional to the square of its overall speed and the overall pressure of a fluid is a constant.

It will therefore be appreciated that if the overall speed of a fluid is reduced, its dynamic pressure decreases.

Therefore, if the dynamic pressure of a fluid decreases, its hydrostatic pressure advantageously increases owing to the fact that the overall pressure is a constant.

Accordingly, the presence of the vane leads in a particularly advantageous manner to an increase in the hydrostatic pressure in the high-pressure flow space.

Preferably, said means comprise a plurality of vanes extending radially while being angularly set apart about the axis of rotation of the pump.

The plurality of vanes allows the distribution of hydrostatic pressure in the high-pressure flow space to be advantageously standardised.

Preferably, two adjacent vanes delimit a groove, one end of which opens radially internally into the high-pressure flow space.

It is beneficial to promote the centripetal flow of the first fluid fraction toward the outlet of the high-pressure flow space.

Advantageously, the axial balancing system further comprises at least one reinjection channel extending between the annular discharge space and a fluid region located upstream of the inlet edge of the centrifugal wheel.

If the take-up force is too great, the annular passage tends to close, as a result of which there is formed a flow restriction at the outlet of the low-pressure flow space, this restriction resulting in an increase in hydrostatic pressure in the low-pressure flow space, thus reducing the axial take-up force communicated to the shaft by the centrifugal wheel.

The reinjection channel thus allows the fluid issuing from the low-pressure flow space to be evacuated.

Preferably, the reinjection channel is provided in the centrifugal wheel.

Advantageously, the annular passage is defined between a first annular rib formed on the downstream face of the centrifugal wheel and a second annular rib formed on the housing.

Advantageously, the first and/or the second flow restriction means comprise an annular seal.

It will be appreciated that the annular seal is permeable in order to allow the fluid to flow.

Preferably, the annular seal is a labyrinth seal.

Further characteristics and advantages of the invention will become clearer on reading the following description of an embodiment of the invention given by way of non-limiting example.

The description will refer to the appended FIGURE showing the upstream portion of a centrifugal-wheel pump comprising an axial balancing system according to the present invention.

The single FIGURE shows a cross-section and elevation of the upstream portion of a pump 10 in accordance with the invention, this pump 10 being intended preferably but not exclusively for the pumping of fluid such as liquefied gas. It may advantageously be used for emptying the tanks of liquefied gas carriers.

In the following description, the adjectives "axial", "tangential" and "radial" are defined relative to the axis of rotation A of the pump 10, whereas the adjectives "upstream" and "downstream" are defined relative to the direction in which the fluid is drawn in.

Moreover, as the pump 10 is generally intended to be arranged vertically, the adjectives "bottom" and "top" will be defined with reference to the vertical position of the pump.

Viewed in the drawing-in direction, indicated in this case by thickly drawn arrows, the pump 10 successively comprises a suction stage 12, a centrifugal wheel 14 and an annular conduit 16 allowing downstream backstreaming of the drawn-in fluid.

The suction stage 12 comprises a rotational impeller 18 equipped with a hub 20 which is driven in rotation by a rotating shaft 22 of the pump 10, the rotating shaft 22 being driven, for its part, by an electric motor (shown in part) arranged downstream of the centrifugal wheel 14.

Furthermore, the centrifugal wheel 14 is also driven in rotation by the rotating shaft 22, with which it is integral.

As may be seen in the FIGURE, the rotating shaft 22 is mounted so as to rotate on a housing 24 of the pump 10 via a bearing 26, for example of the rolling bearing type, the rotating shaft 22 having a shoulder 30 which enters axially into abutment with an inner cage 28 of the bearing 26.

As the pump 10 is arranged vertically, it will be appreciated with reference to the FIGURE that if there is no axial balancing system, the inner cage 28 of the bearing 26 supports the weight of the rotating shaft 22, the rotor of the motor, the centrifugal wheel 14 and the impeller 18—to which weight there is added the tensile force to which the impeller 18 is subjected when the fluid is drawn in.

The general operating principle of an axial balancing system 32 according to the present invention will now be described in greater detail.

In accordance with the invention, the purpose of the axial balancing system 32 is to take up the above-mentioned stresses exerted on the bearing 26.

This stress take-up results from the generation of an axial take-up force opposing the resultant of the above-mentioned stresses, this axial take-up force being exerted on the centrifugal wheel 14.

As the centrifugal wheel 14 is integral with the rotating shaft 22, it will be appreciated that the axial take-up force is transmitted to the rotating shaft 22, thus allowing the axial stresses directed toward the bottom of the pump 10 to be counteracted and the bearing 26 to be relieved.

The manner in which the axial take-up force is generated will now be described.

The axial balancing system 32 comprises a high-pressure centripetal flow space 34 defined between the housing 24 and an upstream face 36 of the centrifugal wheel 14, a low-pressure centripetal flow space 38 defined between the housing 24 and a downstream face 40 of the centrifugal wheel 14.

It will be noted from the FIGURE that the high-pressure flow space 34 comprises an inlet 42 arranged in proximity to the outlet edge 44 of the centrifugal wheel 14 and an outlet 46 arranged in proximity to the inlet edge 48 of the centrifugal wheel 14.

Moreover, the outlet 46 of the high-pressure flow space 34 is equipped with first flow restriction means preferably consisting of a first annular labyrinth seal 50, this seal being partially permeable.

In a particularly advantageous manner, the axial balancing system 32 according to the present invention further comprises a plurality of vanes 52 formed on the housing 24, the vanes 52 extending radially in a centripetal direction from the inlet 42 of the high-pressure flow space 34 while being angularly set apart about the axis of rotation A of the pump 10.

It will be appreciated that there is an interstice between the upstream face 36 of the centrifugal wheel 14 and the housing 24 in such a way that a first fraction of the fluid issuing from the centrifugal wheel 14 is able to surge into the high-pressure flow space 34 during operation of the pump. This flow is indicated in the FIGURE by thinly drawn arrows.

As the flow is restricted at the outlet of the high-pressure flow space 34, it will be understood that the hydrostatic pressure of the first fluid fraction is greater than the hydrostatic pressure of the fluid at the inlet of the centrifugal wheel 14.

When it issues from the centrifugal wheel 14, this first fluid fraction has a tangential speed substantially equal to the speed of the outlet edge 44 of the centrifugal wheel 14.

In accordance with the invention, the radial vanes 52 obstruct the tangential flow of the first fluid fraction in such a way that the first fluid fraction is slowed down by the vanes and flows only in a centripetal radial direction into the high-pressure flow space 34.

This leads to a reduction in the overall speed of the first fluid fraction, said fraction being equal to the square root of the sum of the squares of the tangential, radial and axial components of the fluid speed.

As the dynamic pressure is proportional to the square of the overall speed of the fluid, it will be appreciated that the reduction in the overall speed of the first fluid fraction brings about a reduction in the dynamic pressure of the fluid, as a result of which the hydrostatic pressure of the first fluid fraction increases in a particularly advantageous manner owing to the fact that the overall pressure of the first fluid fraction is a constant.

The hydrostatic pressure of the first fluid fraction therefore remains substantially constant and equal to that of the fluid issuing from the centrifugal wheel 14.

It will also be noted that the low-pressure flow space 38 comprises an inlet 54 arranged in proximity to the outlet edge 44 of the centrifugal wheel 14, said inlet 54 being equipped with second flow restriction means preferably consisting of a second annular labyrinth seal 56, this seal being partially permeable.

It will be understood that there is an interstice between the downstream face 40 of the centrifugal wheel 14 and the housing 24 in such a way that a second fraction of the fluid issuing from the centrifugal wheel 14 is able to surge into the low-pressure flow space 38 during operation of the pump 10. This flow is indicated in the FIGURE by thinly drawn arrows.

With reference to the FIGURE, it will be noted that the low-pressure flow space 38 further comprises an outlet 58 having an annular passage 60 forming an axially variable flow restriction and opening radially onto an annular discharge space 62 defined around said rotating shaft 22 radially internally relative to the annular passage 60.

Furthermore, the annular passage 60 is defined between a first annular rib 60*a* formed on the downstream face 40 of the centrifugal wheel 14 and a second annular rib 60*b* which is integral with the housing 24.

As the axial balancing system 32 allows slight axial displacement of the centrifugal wheel 14 relative to the housing 24, it will be appreciated that the axial width of the annular passage 60 may vary.

The annular space 62 also communicates with a region in which the pressure is lower than that in the low-pressure flow space 38, this region preferably being arranged upstream of the centrifugal wheel 14.

Preferably, at least one reinjection channel 64 provided axially in the centrifugal wheel 14 provides fluid communication between the annular discharge space 62 and the region located upstream of the centrifugal wheel 14.

As the flow is restricted at the inlet of the low-pressure flow space 38, it will be appreciated that the pressure of the second fluid fraction is lower than the pressure of the fluid at the outlet of the centrifugal wheel 14.

It will therefore be appreciated that the hydrostatic pressure differential between the high and low-pressure flow spaces generates an axial take-up force applied to the centrifugal wheel 14 while being oriented toward the top of the pump 10.

This take-up force therefore counteracts the gravitational and tensile forces to which the rotational elements of the pump are subjected and which are applied to the inner cage 28 of the bearing 26.

The axial balancing system according to the present invention thus allows greater relief of the bearing 26.

The annular passage 60 allows the axial balancing to be regulated in the following manner: if the axial take-up force is too great, the annular passage 60 tends to close, thus restricting the flow at the outlet of the low-pressure flow space 38 to a greater extent, as a result of which the hydrostatic pressure in this flow space increases; this leads to a reduction in the axial take-up force.

The reinjection channel 64 allows the second fluid fraction to be reinjected at the inlet of the centrifugal wheel 14, as indicated in the FIGURE by the thinly drawn arrows.

The invention claimed is:

1. A pump for the drawing-in of a fluid, comprising at least one centrifugal wheel having a fluid inlet edge and a fluid outlet edge, the centrifugal wheel being driven in rotation by a shaft mounted so as to be able to rotate relative to a housing of the pump, the pump further comprising an axial balancing system comprising a high-pressure flow space defined between the housing and an upstream face of the centrifugal wheel, a low-pressure flow space defined between the housing and a downstream face of the centrifugal wheel, the high-pressure flow space comprising an inlet arranged in proximity to the outlet edge of the centrifugal wheel and an outlet arranged in proximity to the inlet edge of the centrifugal wheel, said outlet of the high-pressure flow space being equipped with first flow restriction means, the low-pressure flow space comprising an inlet arranged in proximity to the outlet edge of the centrifugal wheel, said inlet of the low-pressure flow space being equipped with second flow restriction means, the low-pressure flow space further comprising an outlet having an annular passage forming an axially variable flow restriction and opening radially onto an annular discharge space defined around said shaft radially internally relative to the annular passage, the annular space communicating with a region in which the pressure is lower than that in the low-pressure flow space, wherein the axial balancing system further comprises a plurality of vanes formed on the housing, said vanes extending radially and in a centripetal direction immediately adjacent the outlet edge of the centrifugal wheel.

2. The pump according to claim 1, wherein said vanes are angularly set apart about the axis of rotation of the pump.

3. The pump according to claim 1, wherein two adjacent vanes delimit a groove, which opens axially internally into the high-pressure flow space.

4. The pump according to claim 1, wherein the axial balancing system further comprises at least one reinjection channel extending between the annular discharge space and a fluid region located upstream of the inlet edge of the centrifugal wheel.

5. The pump according to claim 4, wherein the reinjection channel is provided in the centrifugal wheel.

6. The pump according to claim 1, wherein the annular passage is defined between a first annular rib formed on the downstream face of the centrifugal wheel and a second annular rib formed on the housing.

7. The pump according to claim 1, wherein the first and/or the second flow restriction means comprise an annular seal.

8. The pump according to claim 7, wherein the annular seal is a labyrinth seal.

9. The pump according to claim 1, wherein the vanes are disposed circumferentially around the axis of rotation of the pump and within said high-pressure flow space.

10. The pump according to claim 1, wherein the vanes are configured to obstruct a tangential flow of a fluid surging from the centrifugal wheel into the high-pressure flow space.

* * * * *